US005510586A

United States Patent [19]

Hacking

[11] Patent Number: 5,510,586

[45] Date of Patent: Apr. 23, 1996

[54] SWITCH JOINT FOR ELECTRICAL SWITCHING MATS

[75] Inventor: Duncan Hacking, Near Burnley, England

[73] Assignee: Tapeswitch Corporation of America, Farmingdale, N.Y.

[21] Appl. No.: 371,542

[22] Filed: Jan. 11, 1995

[51] Int. Cl.[6] ..... H01H 3/02

[52] U.S. Cl. ..... 200/86 R

[58] Field of Search ..... 200/86 R, 86 A, 200/85 R; 340/665–668

[56] References Cited

U.S. PATENT DOCUMENTS

| | | | |
|---|---|---|---|
| Re. 24,541 | 9/1958 | Koenig | 200/86 R |
| 2,251,351 | 8/1941 | Cooper | 264/277 |
| 2,896,042 | 7/1959 | Koenig | 200/86 R |
| 2,938,977 | 5/1960 | Koenig | 200/86 R |
| 3,052,772 | 9/1962 | Koenig | 200/61.08 |
| 3,118,984 | 1/1964 | Koenig | 200/61.43 |
| 3,243,540 | 3/1966 | Miller | 200/86 R |
| 3,412,224 | 11/1968 | Koenig | 200/86 R |
| 3,694,600 | 9/1972 | Koenig | 200/86 R |
| 3,710,054 | 1/1973 | Koenig | 200/86 R |
| 3,715,541 | 2/1973 | Koenig | 200/86 R |
| 3,717,735 | 2/1973 | Koenig | 200/85 R |
| 3,722,086 | 3/1973 | Wikkerink et al. | 200/86 R X |
| 3,978,297 | 8/1976 | Lynn et al. | 200/5 A |
| 4,293,752 | 10/1981 | Koenig | 200/295 |
| 4,296,283 | 10/1981 | Koenig et al. | 200/16 D |
| 4,401,896 | 8/1983 | Fowler et al. | 307/118 |
| 4,455,465 | 6/1984 | Habeger | 200/86 R |
| 4,471,177 | 9/1984 | Doughty | 200/5 A |
| 4,483,076 | 11/1984 | Brooks | 200/86 A X |
| 4,551,595 | 11/1985 | Koenig et al. | 200/86 R |
| 4,647,738 | 3/1987 | Diamond | 200/81 H |
| 4,758,815 | 7/1988 | Lovell | 338/212 |
| 4,823,106 | 4/1989 | Lovell | 338/212 |
| 4,963,705 | 10/1990 | Broderick et al. | 200/86 R |
| 4,987,277 | 1/1991 | Duhon | 200/86 R |
| 5,001,310 | 3/1991 | O'Meara, Jr. et al. | 200/86 R |
| 5,118,910 | 6/1992 | Duhon et al. | 200/86 R |
| 5,142,109 | 8/1992 | O'Meara, Jr. et al. | 200/86 R |
| 5,180,900 | 1/1993 | Lovell | 219/517 |
| 5,260,530 | 11/1993 | Duhon et al. | 200/86 R |

*Primary Examiner*—J. R. Scott
*Attorney, Agent, or Firm*—Hoffmann & Baron

[57] ABSTRACT

A switch joint provides pressure-sensitive continuity between a pair of pressure-sensitive electrical switching mats. The mats include an active switching area and an inactive edge. The switch joint is positioned between adjacent inactive edges of the mats. The switch joint includes a housing supporting a pressure-sensitive electrical ribbon switch. The housing further supports an activation member which overlies the inactive edges of the mats. The activation member is movable within the housing to activate the electrical ribbon switch upon pressure applied thereto.

23 Claims, 4 Drawing Sheets

SWITCH JOINT FOR ELECTRICAL SWITCHING MATS

BACKGROUND OF THE INVENTION

The present invention is directed generally to electrical switching devices, and more particularly, the present invention is directed to a switch joint positionable between a pair of pressure-activated electrical switching mats.

Various types of pressure-activated or pressure-sensitive electrical switching devices are known in the art. Switching devices of this type may take many forms and may be embodied in various structures. For example, elongate ribbon switches may be used as window sill alarms or road switches. Switching devices may be incorporated into structures such as passenger seats, activating when the passenger sits in the seat, and also into floor mats used for security or other purposes, to detect movement of objects or pedestrian traffic thereover. Examples of such switching devices are evident in prior patents.

U.S. Pat. Nos. 2,896,042; RE 24,541; 3,142,224; 3,694,600; 3,710,054 and 3,717,735; each to Koenig, show various constructions of electrical ribbon or tape switches. These switches generally include a pair of spaced conductors supported in an insulative jacket. Relatively light pressure on the jacket forces the conductors into electrical engagement, thereby activating the switch.

Electrical pressure-actuated or pressure-sensitive switches have been incorporated into numerous designs of floor mats. The mat design itself may be varied for particular applications. Examples of such pressure-actuated electrical switching mats are also shown in prior patents.

U.S. Pat. No. 2,938,977 to Koenig shows an electrical switching mat having a bottom insulating sheet, a plurality of upper and lower electrical contact strips which are normally electrically isolated, and an upper insulating sheet overlying the contact strips. Pressure on the mat forces the upper and lower contact strips into electrical engagement, activating the electrical switch.

U.S. Pat. No. 3,243,540 to Miller discloses a pressure-actuated electrical switching mat including compressible protective layers made of foam rubber.

U.S. Pat. Nos. 5,001,312 and 5,142,109, each issued to O'Meara, Jr. et al., show a pressure-actuated electrical switching mat having a moisture resistant switching chamber. This switching chamber is protected by a puncture resistant protective layer.

Many of the pressure-actuated electrical switching mats presently in use generally include a major planar pressure-sensitive surface defining an active area. Pressure applied to the mat at this active area, for example by pedestrian traffic or movement of objects thereover, activates the switching device contained in the mat. However, mats of this type also typically include a perimetrical boundary or edge which is nonpressure-sensitive. This pressure-inactive edge, while relatively small in comparison to the active pressure-sensitive surface, still provides an area which, when subjected to pressure, will not activate the switching device contained within the mat. The expanse of the inactive area is multiplied where several mats are used in juxtaposition in situations where it is desired to increase the sensing area. By abutting the inactive edges of the mats adjacent one another, the inactive area may be wide enough so that certain pedestrian traffic or movement of objects may not be detected. This results in the mats not producing the desired effect, i.e., the detection of movement of objects or people thereacross.

SUMMARY OF THE INVENTION

It is therefore an object of the present invention to provide a pressure-sensitive electrical switching device for providing pressure-sensitive continuity between a pair of pressure-sensitive electrical switch mats, where each mat includes a major planar active area and an inactive edge.

It is a further object of the present invention to provide a pressure-sensitive electrical switch joint for positioning between a pair of pressure-sensitive electrical switch mats along abutting inactive edges thereof.

It is a still further object of the present invention to provide a pressure-sensitive electrical switch joint which employs an activation member which overlies the inactive edges of abutting pressure-sensitive switching mats so that the area of pressure inactivity defined by the edges of the mats is eliminated.

In the efficient attainment of these and other objects, the present invention provides a pressure-sensitive electrical switch joint assembly for providing pressure-sensitive continuity between a pair of electrical switch mats. The electrical switch mats are generally planar, having a pressure-sensitive activation surface and an elongate inactive edge. The edge of one mat is positioned adjacent the edge of the other mat and the adjacent edges thereby define a larger inactive area. The electrical switch joint assembly includes an elongate switch joint housing positionable between the mats and having a portion thereof extending between the mat edges. An activatable pressure-sensitive ribbon switch is positioned within the housing. An activation member is movably supported by the switch joint housing. The activation member includes a generally flat upper surface overlying the inactive mat edges, and further includes a depending element extending into the housing for engagement with the ribbon switch upon manual depression thereof to activate the ribbon switch.

As particularly described by way of the preferred embodiment herein, the switch joint housing includes a generally flat base portion which underlies the abutting inactive edges of the mats. The upstanding portion extending between the mats includes an upwardly opening channel which receives the ribbon switch. The activation member includes a depending element extending into the upwardly opening channel for actuatable engagement with the ribbon switch, upon manual pressure applied to the upper surface of the activation member. The switch joint housing captively retains the activation member in position over the abutting edges of the mat to prevent removal thereof.

DETAILED DESCRIPTION OF THE PREFERRED EMBODIMENT

Figure 1:
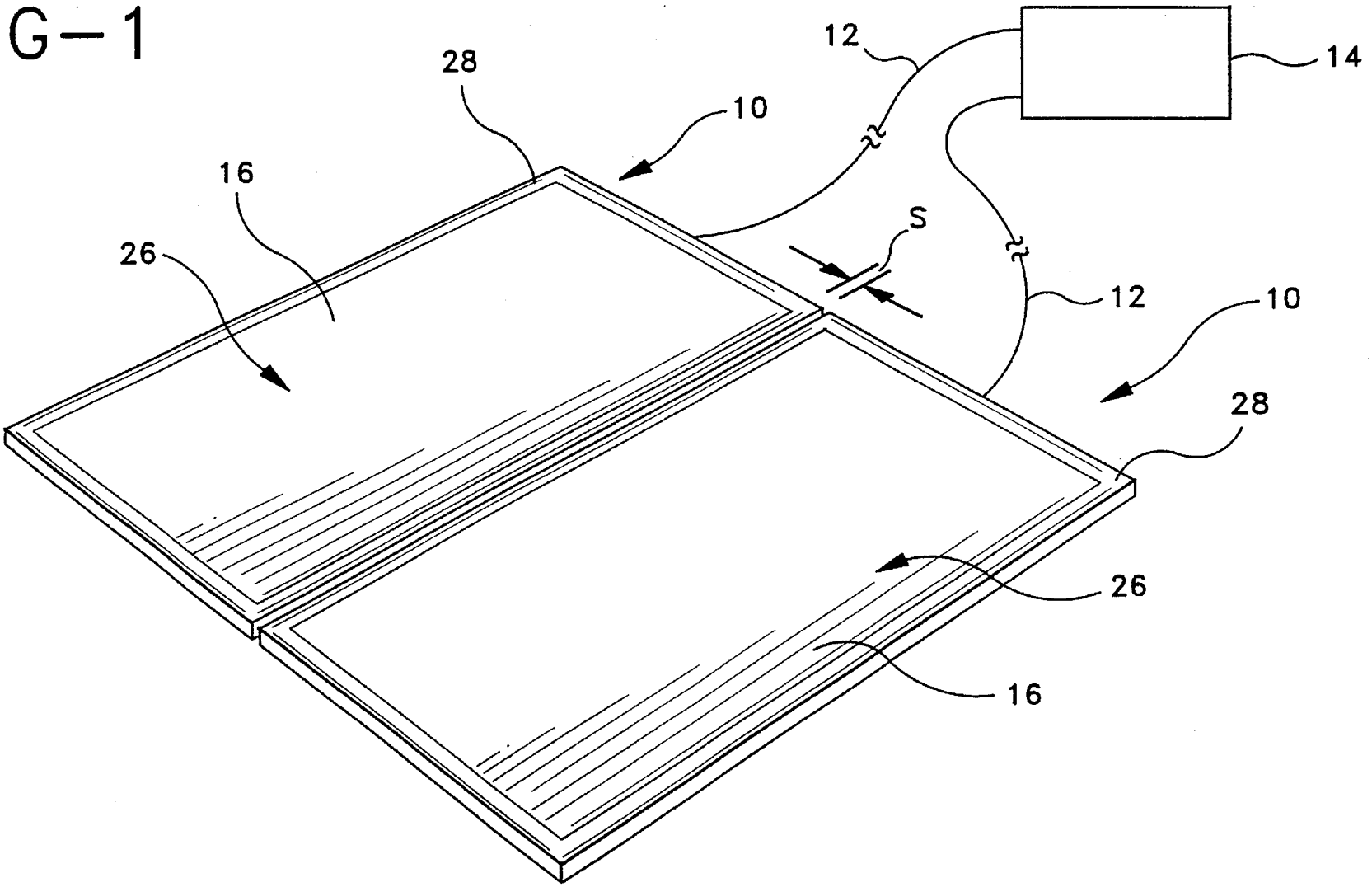
FIG. 1 is a perspective view of a pair of pressure-sensitive electrical switching mats positioned side-by-side.

Referring now to FIG. 1, a pair of conventional electrical switching mats 10 are shown. Each switching mat 10 is generally of flat rectangular configuration including an extending electrical cable 12 which serves to connect an electrical switching device of the switching mat 10 to a power source/signal receiver 14.

Figure 5:
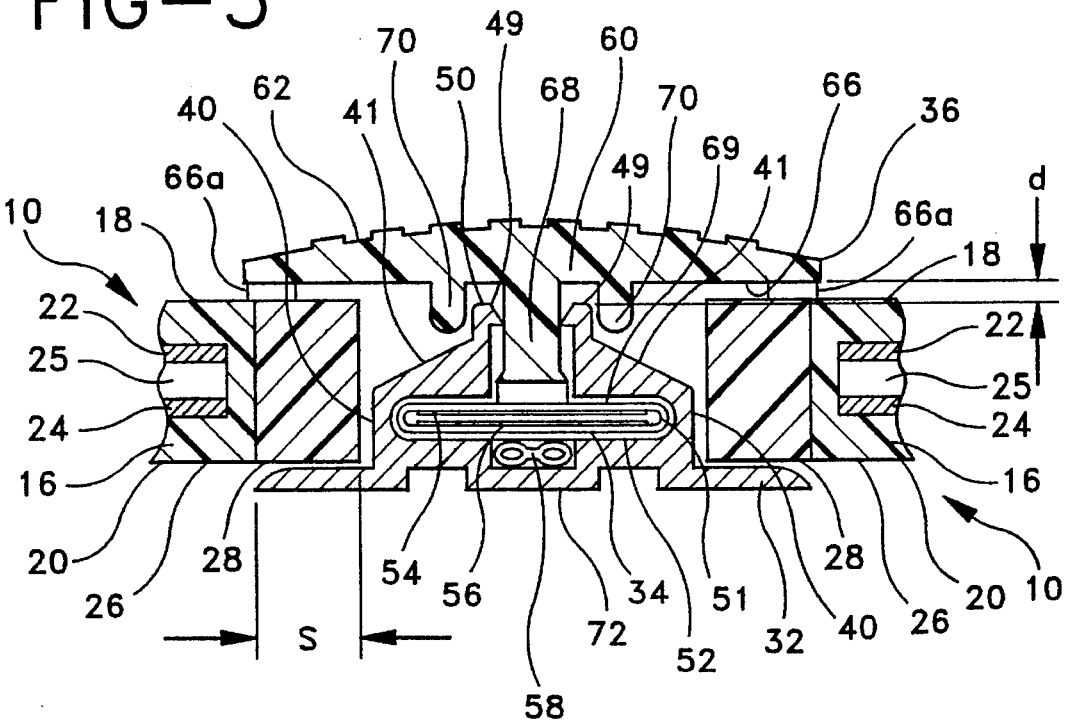
FIG. 5 is a cross-section of the electrical switch joint assembly and mats of FIG. 4 taken along the lines 5—5 thereof.

Referring additionally to FIG. 5, each switching mat 10 includes a planar body 16 preferably formed of wear-resistant rubber or other elastomeric material. Body 16 defines opposed upper and lower planar surfaces 18 and 20 which support therebetween a pair of vertically spaced electrical conductors 22 and 24 defining a switching device 25. In the normal condition as shown in FIG. 5, conductors 22 and 24 are spaced apart in electrical isolation. Pressure upon upper surface 18 causes conductor 22 to move into electrical engagement with conductor 24 thereby activating the switching device 25. The electrical switching device can be of the normally open or normally closed type.

While an example of a simple switching device 25 is shown herein for illustrative purposes, other types of switching mats employing various different pressure-actuated the scope of the present invention. Examples of such pressure-activated switching mats and other switching devices are described in the above-referenced patents.

As shown in FIGS. 1 and 5, each of mats 10 includes a major centrally located activation area 26 which generally directly overlies conductors 22 and 24 forming the switching device 25. Activation area 26 is positioned such that pressure applied thereto will actuate the switching device 25. Mats 10 include a perimetrical edge 28 surrounding activation area 26 which is transversely spaced from conductors 22 and 24. Edge 28 defines an inactive area within which depression of upper surface 18 will not cause electrical engagement of conductors 22 and 24. Mats 10 may be constructed with such pressure-inactive edges 28 so as to facilitate ease of manufacture, durability and assembly of the mats. Each pressure-inactive edge 28 generally has a width of s which in certain constructions may be as much as 1 inch. Pressure applied to the pressure-inactive edge 28 will not result in a switching signal being sent to receiver 14, so that such pressure will not be sensed. While the pressure-inactive edge 28 is of relatively small dimension, it is possible for certain objects or pedestrian traffic to move over mats 10 without being sensed. This problem is especially prevalent where plural mats are used in side-by-side relationship, as shown in FIG. 1, in an effort to extend the sensing area. When abutting two similarly formed mats 10, adjacent edges 28 of each mat will be brought into close proximity. This now more than doubles the pressure-inactive area defined by the adjacent edges. Thus, it is more likely that certain movement of objects or pedestrian traffic will fail to be sensed by adjacently positioned switching mats 10.

The present invention provides a switching joint for overlying the abutting inactive edges 28 of mats 10 to thereby provide pressure-sensitive continuity between mats 10.

Figure 2:
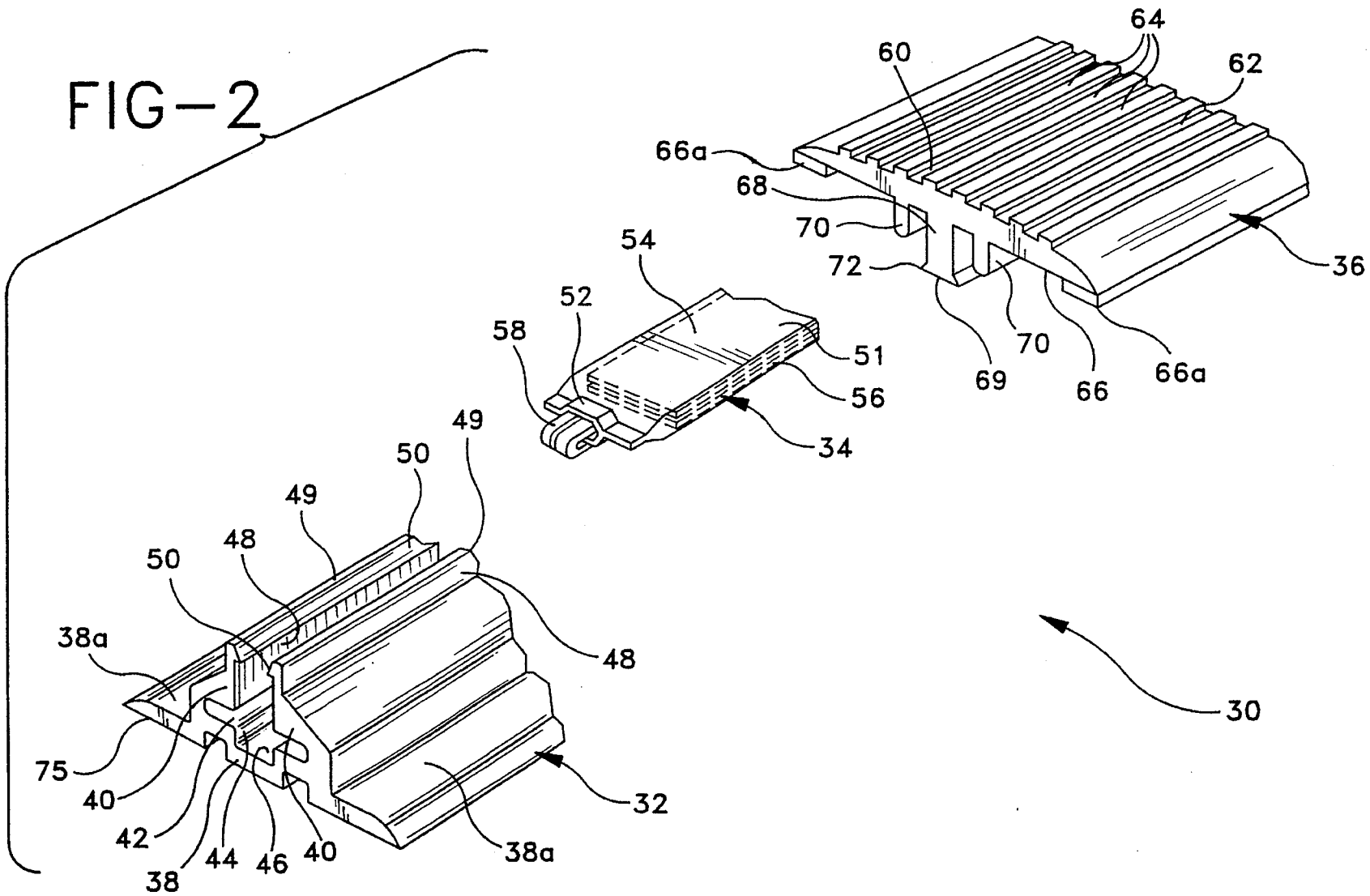
FIG. 2 is an exploded perspective view of a portion of the pressure-sensitive electrical switch joint assembly of the present invention.
Figure 3:
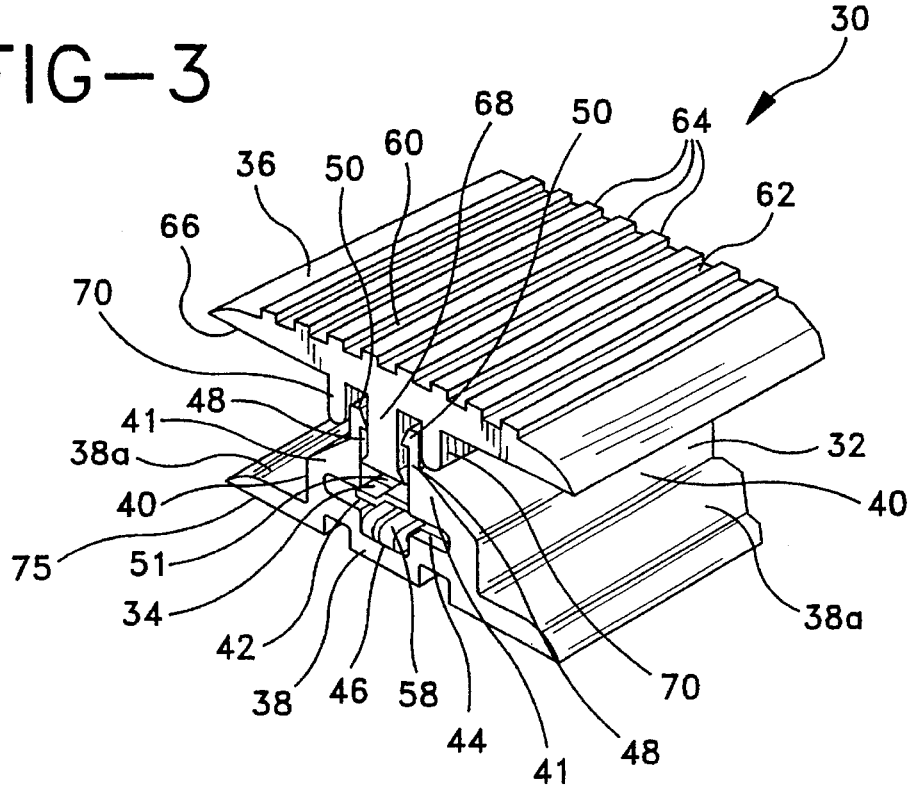
FIG. 3 is a perspective view of a portion of the assembled electrical switch joint assembly of FIG. 2.

Referring now to FIGS. 2, 3 and 5, the pressure-sensitive electrical switch joint 30 of the present invention may be described. Switch joint 30 is a multicomponent device including a housing 32, an electrical ribbon switch 34 and an activation member 36 overlying housing 32 and ribbon switch 34.

Housing 32 is an elongate member which, as shown in the preferred embodiment, may be formed of metal such as aluminum. However, any suitably rigid material may also be employed. Housing 32 includes a base portion 38 having a pair of oppositely directed flat base extensions 38*a*. Extending upwardly from base 38 is a pair of transversely spaced centrally located arms 40. Arms 40 define an upwardly opening channel 42 therebetween, which is configured to accommodate ribbon switch 34. Channel 42 includes a main channel portion 44 and an auxiliary channel portion 46 in communication with and depending from main channel portion 44. Channel 42 accommodates ribbonswitch 34 in a manner which will be described in further detail hereinbelow. Arms 40 include a pair of transversely spaced upper arm extensions 48 for permitting insertion therebetween of activation member 36. The distal ends 49 of arm extensions 48 include inwardly directed protrusions 50 which serve to captively retain activation member 36 therein in a manner which will be described in further detail hereinbelow.

Figure 4:
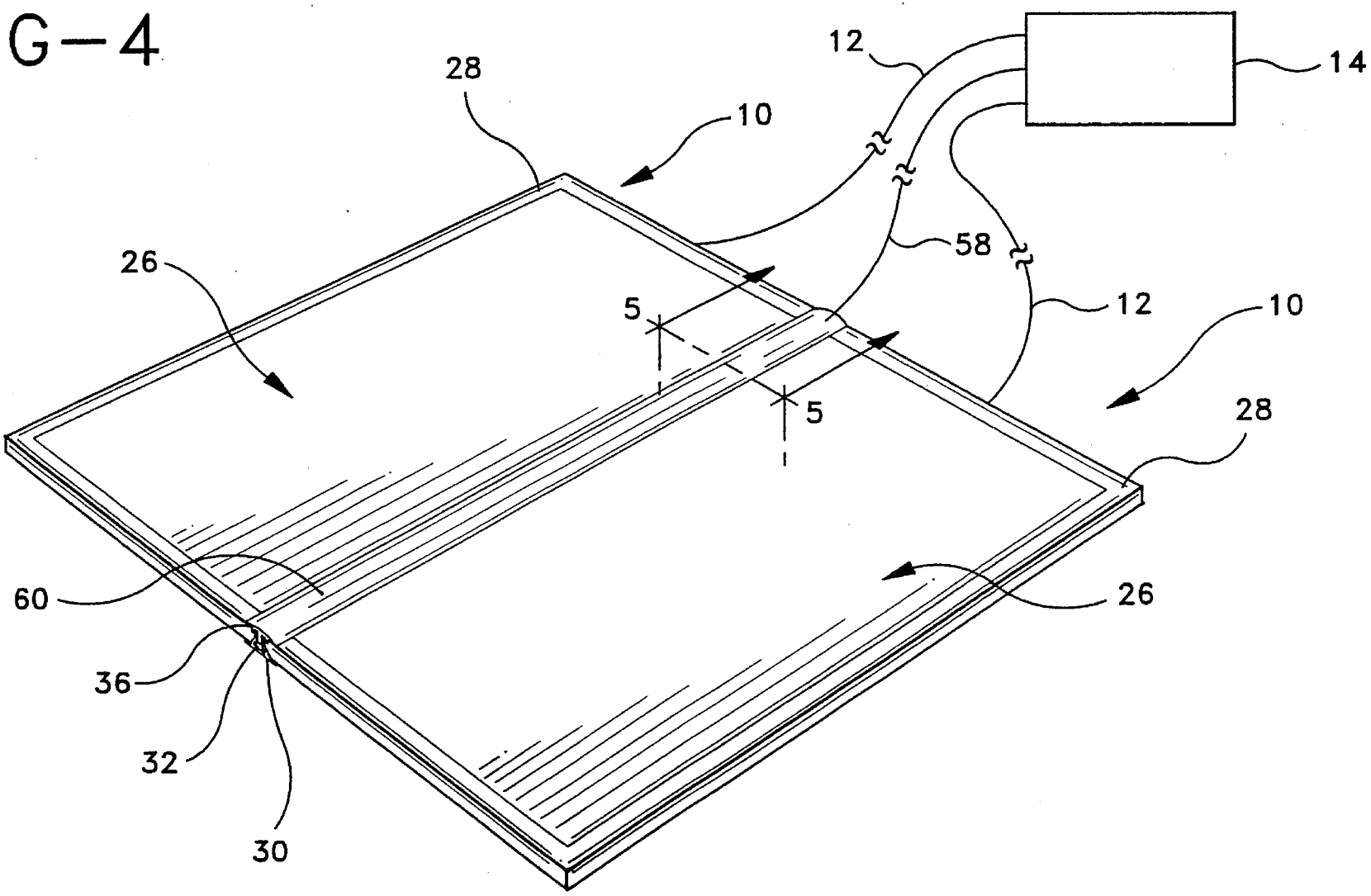
FIG. 4 is a perspective view of the electrical switch joint assembly of FIG. 2 positioned between the pressure-sensitive switching mats of FIG. 1.

Electrical ribbon switch 34 is a conventional flat ribbon type switch. It includes a switch body 51 which is defined by an elongate electrically insulative jacket 52. Body 51 supports therein a pair of upper and lower electrical conductors 54 and 56 in spaced apart relationship. Conductors 54 and 56 are electrically connected via a conventional two-conductor electrical cable 58 and may be attached to power source/signal receiver 14 as shown in FIG. 4. Ribbon switch 34 may be either a normally open or normally closed switch depending upon the type of mat 10 which is used therewith. Ribbon switch 34 operates in a conventional fashion. Pressure applied to jacket 52 will cause conductors 54 and 56 to move into electrical engagement, thereby sending a signal to receiver 14. The signal sent to receiver 14 is preferably of the same polarity and of similar magnitude as the signal sent by switching device 25 of mat 10. Thus, pressure applied to switching device 25 of mats 10 or ribbon switch 34 of switch joint assembly 30 will be similarly sensed. Any of a wide variety of conventional ribbon switches 34 may be employed in accordance with the present invention. Examples of such conventional ribbon switches are described in the above-referenced patents.

Ribbon switch 34 is positioned within channel 42 of housing 32 such that the ribbon switch body 51 is positioned within main channel portion 44. Electrical cable 58 may be positioned beneath body 51 of ribbon switch 34 and is accommodated in auxiliary channel portion 46. The provision of auxiliary channel portion 46 allows the user the option of extending electrical cable 58 along the length of housing 32 where a particular application requires such positioning. In this position cable 58 serves as a bead assisting in the activation of ribbon switch 34 upon the application of pressure thereto.

Activation member 36 is an elongate member formed of relatively inflexible plastic such as extruded polyvinyl chloride. Activation member 36 includes a generally planar portion 60 having a slightly curved or arched upper surface 62. Plural undulations 64 may be included along upper surface 62 to provide for increased traction and skid resistance. Planar portion 60 of activation member 36 includes a flat lower surface 66 opposite upper surface 62. Lower surface 66 includes a depending central activation rib 68 extending longitudinally therefrom. Activation rib 68 includes a bottom edge 69 which, when activation member 36 is positioned on housing 32 as shown in FIG. 3, may lightly engage and rest on ribbon switch 34. In this position lower surface 66 of planar portion 60 of activation member 36 is held spaced from the distal ends 49 of arm extensions 48. Any light engagement of edge 69 with ribbon switch 34 would not be sufficient to activate ribbon switch 34. It is only upon further manual depression of activation member 36 that activation rib 68 will move downwardly into pressure engagement with ribbon switch 34 and force conductors 54 and 56 into electrical engagement.

The vertical expanse of activation rib 68 is constructed so that it will provide a clearance or gap between the distal ends 49 of arm extensions 48 and the lower surface 66 of planar portion 60 of activation member 36. The gap d (FIG. 5) is sufficient to permit movement of activation member 36 toward ribbon switch 34 to the extent necessary to cause electrical engagement of conductors 54 and 56 to thereby activate ribbon switch 34. Compressible spacers 66A are preferably attached to the lower surface 66 as shown in the figure. Accordingly, debris is prevented from lodging itself between the lower surface 66 and upper surface 18. Accumulation of debris might otherwise impede downward movement and therefore activation. The spacers 66A may be positioned as shown in FIG. 2 but are not limited to any particular configuration as long as they carry out the desired function. For example, the spacers may extend the full length of lower surface 66. The compressible spacers may be any material known to those skilled in the art which will easily compress and substantially retain its original shape after a depressing pressure is removed. The switch 30 also preferably includes a seal or barrier to debris located at the side edges of the switch. The seal is to prevent debris from entering the switch and obstructing operation.

Lower surface 66 further includes a pair of spaced apart longitudinal depending lateral ribs 70, one rib 70 positioned on either side of rib 68. Lateral ribs 70 are positioned to extend outside of arm extensions 48. Lateral ribs 70 extend into engagement with outer beveled shoulders 41 of arms 40. Activation member 36 is prevented from rocking from side to side by the engagement of lateral ribs 70 with shoulders 41 of arms 40. This stabilizes activation member 36 in position over housing 32. In addition, the positioning of depending lateral ribs 70 prevents a downward overextension by activation rib 68 which could possibly damage housing 32.

In order to captively retain activation member 36 within housing 32 and prevent inadvertent dislodgement of activation member 36 therefrom, cooperating retaining structure including protrusions 50 is provided. The distal extent of activation rib 68 adjacent the bottom edge 69 thereof includes opposed outwardly directed elongate ledges 72. Ledges 72 are designed to ride beneath protrusions 50 of arm extensions 48 to prevent vertical removal of activation member 36 from housing 32.

Switch joint 30 is assembled in the following manner. Ribbon switch 34 is inserted into channel 42 of housing 32 through one end 75 thereof. The body 51 of ribbon switch 34 is positioned in main channel portion 44 while electrical cable 58 may be positioned within auxiliary channel portion 46. Activation member 36 may be similarly inserted in a sliding manner into housing 32 from one end 75 thereof. Activation rib 68 is inserted between arm extensions 48 while lateral ribs 70 are positioned on either side of arm extensions 48. Ledges 72 of activation rib 68 ride under protrusions 50 of arm extensions 48.

Referring now to FIGS. 4 and 5, the assembled combination of switch joint 30 of the present invention and mats 10 may be described. Switch joint 30 is positioned between mats 10 which have been arranged in side-by-side, closely spaced relationship. Pressure-inactive edges 28 of mats 10 are positioned slightly spaced apart to permit insertion of switch joint 30 therebetween. Switch joint 30 is inserted between mats 10 so that edges 28 thereof overlie the outwardly directed base extensions 38*a* of base 38. Upwardly extending arms 40 of housing 32, as well as channel 42, extend between edges 28. Mats 10 may be adjusted so that the edges 28 tightly abut against arms 40. Mats 10 may be positioned over base 38 of housing 32 either with activation member 36 supported on housing 32 or removed therefrom. In the latter situation, activation member 36 may be subsequently positioned in a slidable manner over housing 32.

Planar portion 60 of activation member 36 spans the pressure-inactive edges 28 of mats 10. Planar portion 60 is constructed to have a width which is wider than twice the width of each mat edge 28 (in the present example 2 ½ inches) so that it will span the adjacent edges 28 of both mats 10 which have been spaced apart sufficiently to permit positioning of housing 32 therebetween. However, in the preferred form the width of planar portion 60 is selected so as not to extend much beyond edges 28. This prevents inadvertent activation of switching device 25 contained in mats 10. As the upper surface 62 of planar portion 60 of activation member 36 is slightly arched it provides a relatively smooth transition between the mats 10. Movement of objects and pedestrians over switch joint 30 is facilitated by this smooth transition.

Positioning of switch joint 30 in a manner shown in FIGS. 4 and 5 completely eliminates the pressure-inactive area formed by the abutting edges 28 of mats 10. Thus, pressure applied either by movement of objects or pedestrian traffic at the juncture of mats 10, which would otherwise be outside the activation areas 26 of mats 10, will cause activation of ribbon switch 34 supported within housing 32. This eliminates the pressure-inactive area which would normally be formed by the adjacent pressure-inactive edges 28 of mats 10.

The present invention is primarily designed to be used over the abutting inactive edges of a pair of switching mats. However, it is contemplated that the present invention may be employed to span a gap between two switching mats and provide pressure-sensitive continuity therebetween.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed:

1. A pressure-sensitive electrical switch joint assembly for providing pressure-sensitive continuity between first and second electrical switch mats, each of said mats being generally planar and having a pressure-sensitive active area and an elongate inactive edge, said edge of said first mat being positioned adjacent said edge of said second mat, said switch joint assembly comprising:

an elongate switch joint housing positionable between said mats and having a generally flat base portion underlying said edges of said mats and an upstanding portion extending between said mat edges, said upstanding portion having an elongate upwardly opening channel;

an elongate activatable pressure-sensitive electrical ribbon switch positioned within said channel; and an elongate activation member moveably supported by said housing, said activation member having a generally flat upper surface for overlying said edges of said mats and a depending element extending into said upwardly opening channel for activatable engagement with said pressure-sensitive ribbon switch upon depression thereof to activate said ribbon switch, said upper surface of said activation member having a lower face, said lower face and said generally flat base portion of said housing together defining first and second mat edge receiving regions on first and second sides of said upstanding portion of said housing for respective receipt of said edges of said first and second mats.

2. The pressure-sensitive electrical switch joint assembly of claim 1 wherein said activation member is generally T-shaped.

3. The pressure-sensitive electrical switch joint assembly of claim 2 wherein said ribbon switch includes a pair of vertically spaced electrical conductors enclosed in an insulative jacket, said conductors being urged into electrical engagement upon depression of said activation member to activate said ribbon switch.

4. The pressure-sensitive electrical switch joint assembly of claim 3 wherein said upstanding portion of said housing includes a pair of spaced apart walls defining therebetween an opening in communication with said channel for receipt of said depending element of said activation member.

5. The pressure-sensitive electrical switch joint assembly of claim 4 wherein said spaced apart walls include upper edges and said upper edges of said spaced apart walls include inwardly directed protrusions, and wherein said depending element includes a pair of outwardly directed ledges, said protrusions and said ledges cooperating to captively support said activation member in said housing.

6. The pressure-sensitive electrical switch joint assembly of claim 5 wherein said ribbon switch includes a generally flat ribbon switch body and an electrical connecting cable.

7. The pressure-sensitive electrical switch joint assembly of claim 6 wherein said channel includes a first channel portion for accommodating said flat ribbon switch body and a second channel portion for accommodating said cable.

8. The pressure-sensitive electrical switch joint assembly of claim 7 wherein said cable generally underlies said flat ribbon switch body, said cable defining a bead facilitating activation of said ribbon switch.

9. In combination:

first and second pressure-sensitive electrical switch mats each having a major planar pressure-sensitive switching surface and a non-switching edge, said mats being positioned in side-by-side relationship with said edge of said first mat being adjacent said edge of said second mat;

a mat joint housing positioned between said mat edges, said housing having a generally flat base underlying said mat edges and an upstanding portion extending between said mat edges;

an activatable electrical switch supported within said housing; and an activation member moveably supported by said housing, said activation member having a first portion overlying said edges of said mats and a second portion engageable with said switch to activate said switch when pressure is placed upon said first portion, said first portion of said activation member having a lower face, said lower face and said generally flat base of said housing together defining first and second mat edge receiving regions on first and second sides of said upstanding portion of said housing for respective receipt of said edges of said first and second mats.

10. The combination of claim 9 wherein said activation member is captively retained by said housing.

11. The combination of claim 10 wherein said activation member first portion is generally co-planar with said major surfaces of said mats.

12. The combination of claim 11 wherein said second portion of said activation member extends perpendicularly to said first portion.

13. A pressure-activatable electrical switching device for positioning between first and second electrical switch mats, each mat having a pressure-inactive edge, said edges of said mats being positioned adjacent one another, said switching device comprising:

a housing positionable between said edges of said mats;

a pressure-activated switch supported within said housing; and an activation member moveably supported by said housing for activatable engagement with said switch, said activation member including a portion thereof overlying said edges of said mats to cover said pressure-inactive edges, said overlying portion of said activation member having a lower face, said lower face and said housing together defining first and second mat edge receiving regions on first and second sides of said housing for respective receipt of said edges of said first and second mats.

14. The pressure-activatable electrical switching device of claim 13 wherein said housing includes a cavity and wherein said switch is supported within Said cavity.

15. The pressure-activatable electrical switching device of claim 14 wherein said activation member includes a first portion overlying said edges of said mats and a second portion extending into said cavity for engagement with said switch.

16. The pressure-activatable electrical switching device of claim 15 wherein said second portion of said activation member is captively retained in said housing cavity.

17. A pressure-sensitive device for providing pressure-sensitive continuity between first and second adjacent pressure-sensitive electrical switching mats located in first and second regions respectively and having a gap therebetween, said device comprising:

a switch joint assembly including:

a housing;

a pressure-sensitive electrical switch supported within said housing;

an activation member extending between said electrical switching mats, said activation member being movably supported by said housing for switching engagement with said switch upon pressure being placed on said activation member, said switch joint assembly having first and second sides respectively defining boundaries of said first and second regions in which said first and second mats are located, said activation member being configured and dimensioned to span said gap, thereby providing pressure-sensitive continuity between said mats.

18. The pressure-sensitive device of claim 17 wherein each of said mats includes a longitudinal edge, said edge of said first mat being spaced from said edge of said second mat to define said gap, and wherein said activation member is positioned within said gap between said edges of said mats.

19. The pressure-sensitive device of claim 18 wherein said activation member includes oppositely directed generally planar extending portions for overlying said edges of said mats.

20. The pressure-sensitive device of claim 18 wherein said housing is positioned to extend between said edges of said mats.

21. The pressure-sensitive device of claim 20 wherein said housing includes oppositely directed extending portions for positioning beneath said edges of said mats.

22. The pressure-sensitive device of claim 18 wherein said electrical switch is a ribbon switch.

23. The pressure-sensitive device of claim 22 wherein said activation member includes a first planar portion for overlying said mat edges and a second portion extending into said housing for engagement with said ribbon switch.

* * * * *